US010006141B2

(12) United States Patent
Monteiro et al.

(10) Patent No.: US 10,006,141 B2
(45) Date of Patent: Jun. 26, 2018

(54) METHOD TO PRODUCE METAL MATRIX NANOCOMPOSITE

(71) Applicants: Othon Monteiro, Houston, TX (US); Oleg Mazyar, Houston, TX (US); Valery Khabashesku, Houston, TX (US)

(72) Inventors: Othon Monteiro, Houston, TX (US); Oleg Mazyar, Houston, TX (US); Valery Khabashesku, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 783 days.

(21) Appl. No.: 13/922,433

(22) Filed: Jun. 20, 2013

(65) Prior Publication Data

US 2014/0374267 A1 Dec. 25, 2014

(51) Int. Cl.

| | |
|---|---|
| ***C25D 15/00*** | (2006.01) |
| ***C25D 5/10*** | (2006.01) |
| *C25D 3/66* | (2006.01) |
| *C25D 3/02* | (2006.01) |
| *C25D 5/18* | (2006.01) |
| *C23C 18/16* | (2006.01) |

(52) U.S. Cl.

CPC ..... *C25D 15/00* (2013.01); *C25D 5/10* (2013.01); *C23C 18/1662* (2013.01); *C25D 3/02* (2013.01); *C25D 3/665* (2013.01); *C25D 5/18* (2013.01)

(58) Field of Classification Search

CPC ..... C25D 15/00

USPC ..... 205/109

See application file for complete search history.

(56) References Cited

U.S. PATENT DOCUMENTS

| | | | | |
|---|---|---|---|---|
| 2005/0205425 | A1* | 9/2005 | Palumbo | C25D 1/04 204/499 |
| 2007/0158619 | A1 | 7/2007 | Wang et al. | |
| 2007/0199826 | A1 | 8/2007 | Son et al. | |
| 2007/0298669 | A1 | 12/2007 | Barrera et al. | |
| 2009/0242414 | A1 | 10/2009 | Welz-Biermann et al. | |
| 2010/0096139 | A1 | 4/2010 | Holcomb et al. | |

(Continued)

FOREIGN PATENT DOCUMENTS

| | | |
|---|---|---|
| CN | 102304737 A | 1/2012 |
| CN | 102329976 B | 1/2012 |

(Continued)

OTHER PUBLICATIONS

Liu et al., "Direct Electrodeposition of Graphene Enabling the One-Step Synthesis of Graphene-Metal Nanocomposite Films" Small 7(9), pp. 1203-1206 (2011).*

(Continued)

*Primary Examiner* — Bryan D. Ripa

(74) *Attorney, Agent, or Firm* — Cantor Colburn LLP

(57) ABSTRACT

A method for coating a substrate includes disposing a deposition composition in a container. The deposition composition includes a plurality of nanosheets and a metal material. The method also includes disposing a substrate in the container, contacting the substrate with the deposition composition, applying a voltage to the substrate, electrodepositing, on the substrate, a coating that includes a metal from metal ions and the nanosheets in response to biasing the substrate at the first potential.

24 Claims, 3 Drawing Sheets

(56) References Cited

U.S. PATENT DOCUMENTS

| | | | | |
|---|---|---|---|---|
| 2011/0024299 | A1 | 2/2011 | Reusmann | |
| 2011/0100825 | A1* | 5/2011 | Heinrichsdorff | C25D 7/00 205/50 |
| 2011/0108269 | A1 | 5/2011 | Van Den Berg et al. | |
| 2013/0029170 | A1* | 1/2013 | John | C25D 5/18 428/596 |
| 2013/0165353 | A1 | 6/2013 | Mazyar et al. | |
| 2014/0096964 | A1 | 4/2014 | Chakraborty et al. | |
| 2014/0187449 | A1 | 7/2014 | Khabashesku et al. | |
| 2015/0047847 | A1 | 2/2015 | Mazyar et al. | |
| 2016/0122551 | A1 | 5/2016 | Suresh et al. | |

FOREIGN PATENT DOCUMENTS

| | | | |
|---|---|---|---|
| CN | 102354609 | A | 2/2012 |
| CN | 102560415 | A | 7/2012 |
| CN | 102719693 | A | 10/2012 |
| EP | 1826294 | A1 | 8/2007 |
| EP | 2838166 | | 2/2015 |
| JP | 2012126951 | A | 7/2012 |
| JP | 2012-200989 | A | 10/2012 |
| KR | 20110052158 | A * | 5/2011 |
| KR | 1020120027350 | A | 3/2012 |
| WO | 2011159922 | A2 | 12/2011 |
| WO | 2012138302 | A1 | 10/2012 |

OTHER PUBLICATIONS

Pei et al., "The Reduction of Graphene Oxide" Carbon 50, pp. 3210-3228 (2012).*

Machine Translation KR20110052158A.*

Wang et al., "Graphene-based materials: Fabrication, characterization and application for the decontamination of wastewater and wastegas and hydrogen storage/generation" Adv. Colloid Interface Sci. 195-196, pp. 19-40 (2013).*

International Search Report and Written Opinion for related PCT Application No. PCT/US2014/043376, dated Oct. 22, 2014, pp. 1-13.

Agrawal et al., U.S. Appl. No. 14/744,520, filed Jun. 19, 2015, and titled Methods and Suspensions for Recovery of Hydrocarbon Material From Subterranean Formations.

Alvarado et al., "Enhanced Oil Recovery: An Update Review", Energies, vol. 3, (2010), pp. 1529-1575.

Bryant et al., "Development of Nanoparticle-Stabilized Foams to Improve Performance of Water-less Hydraulic Fracturing", Quarterly Progress Report, Oct. 1, 2013-Dec. 13, 2013, 16 pages.

Chakraborty et al., U.S. Appl. No. 14/519,496, filed Oct. 21, 2014, and titled Suspensions for Enhanced Hydrocarbon Recovery, and Methods of Recovering Hydrocarbons Using the Suspensions.

Drexler et al., Amphiphilic Nanohybrid Catalysts for Reactions at the Water/Oil Interface in Subsurface Reservoirs, Energy & Fuels, vol. 26, (2012), pp. 2231-2241.

Kuznetsov et al., U.S. Appl. No. 14/289,838, titled Methods of Obtaining a Hydrocarbon Material From a Mined Material, and Related Stabilized Emulsions, filed May 29, 2014.

Kuznetsov et al., U.S. Appl. No. 14/296,857, titled Flocculants and methods for Recovering Bitumen From Oil Sands, filed Jun. 5, 2014.

Luu et al., "Nanoparticles Adsorbed at the Water/Oil Interfaces: Coverage and Composition Effects on Structure and Diffusion", American Chemical Society, Langmuir, vol. 29, (2013), pp. 7221-7228.

McElfresh et al., "Application of Nanofluid Technology to Improve Recovery in Oil and Gas Wells", Society of Petroleum Engineers, (2012), SPE 154827, 6 pages.

Shen et al., "Emulsions Stabilized by Carbon Nanotube-Silicon Nanohybrids", Languir, vol. 25, No. 18, (2009), pp. 10843-10851.

Suresh et al., U.S. Appl. No. 14/169,432, filed Jan. 31, 2014, and titled Nano-surfactants for Enhanced Oil Recovery, and Methods of Forming and Using Such Nano-surfactants.

Suresh et al., U.S. Appl. No. 14/289,873, filed May 29, 2014, and titled Suspensions including organic bases for enhanced oil recovery and methods of obtaining hydrocrabons using such suspensions.

Suresh et al., U.S. Appl. No. 14/530,205 entitled, Compositions of Coated Diamond Nanoparticles, Methods of Forming Coated Diamond Nanoparticles, and Methods of Forming Coatings, filed Oct. 31, 2014.

Wasan et al., "Spreading of Nanofluids on Solids", Nature, vol. 423, May 8, 2003, pp. 156-159.

Xue et al., "Functionalization of Graphene Oxide with Polyhedral Oligomeric Silsesquioxane (POSS) for Multifunctional Applications", Journal of Physical Chemistry Letters, vol. 3, (2012), pp. 1607-1612.

Bohua WU et al., "Functionalization of Carbon Nanotubes by an Ionic-Liquid Polymer: Dispersion of Pt and PtRu Nanoparticles on Carbon Nanotubes and Their Electrocatalytic Oxidation of Methanol", Electrochemistry, DOI: 10.1002/anie.200900899, Angew. Chem. Int. Ed. 2009, 48, p. 4751-4754.

Jeng-Kuei Chang et al., "Electrodeposition of aluminum on magnesium alloy in aluminum chloride (AlCl3)-1-ethyl-3-methylimidazolium chloride (EMIC) ionic liquid and its corrosion behavior", Electrochemistry Communications 9 (2007) 1602-1606.

Tetsuya Tsuda et al., "Electrochemical Applications of Room-Temperature Ionic Liquids", The Electrochemical Society Interface, Spring 2007, p. 42-49

Wojciech Simka et al., "Electrodeposition of metals from non-aqueous solutions", Elsevier, Electrochimica Acta 54 (2009) 5307-5319.

Arkles et al., "Cyclic azasilanes: volatile coupling agents for nanotechnology", Silanes and Other Coupling Agents, 2004, vol. 3, pp. 179-191.

European Search Report, European Application No. 14813898.5, dated Jan. 30, 2017, European Patent Office; European Search Report 9 pages.

Krueger, Anke "New Carbon Materials: Biological Applications of Functionalized Nanodiamond Materials", Chem. Eur. J., 14 (2008) 1382-1390.

* cited by examiner

METHOD TO PRODUCE METAL MATRIX NANOCOMPOSITE

BACKGROUND

To combat the effects of wear-intensive or corrosively inhospitable environments, equipment and tools are coated with protective coatings. In particular, hard coatings are included on the equipment and tools to improve wear ability and prolong their lifetime. The hard coatings include various ceramics or metals. For corrosion proofing, polymers have been applied. Typical polymeric coating can fail at elevated temperatures or under high loadings, and metal coatings still are lacking in certain aspects such as weight-to-strength ratio.

Therefore, the development of a coating that can be used to protect or enhance the performance of components and tools having mechanical properties necessary to perform their intended function is very desirable.

BRIEF DESCRIPTION

The above and other deficiencies are overcome by, in an embodiment, a 1. A method for coating a substrate comprises disposing a deposition composition in a container, the deposition composition comprising: a plurality of nanosheets; and a metal material to produce metal ions in the deposition composition; disposing a substrate in the container; contacting the substrate with the deposition composition; applying a voltage between the substrate and a counter electrode, the substrate being a cathode, and the counter electrode being an anode; electrodepositing, on the substrate, a coating comprising: a metal from the metal ions; and the nanosheets.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments is presented herein by way of exemplification and not limitation.

It has been found that a metal matrix nanocomposite made of nanosheets and metal deposited form a coating on a substrate with beneficial properties. The resulting coating is lightweight, magnetic or nonmagnetic, strong, and hard. The coating also has advantageous barrier properties, selectable permeability, and a coefficient of friction that is reduced compared to metal coatings without nanosheets. Moreover, the metal matrix nanocomposite has a composition and microstructure that is configurable at the micro or nanoscale to control its material, chemical, or physical properties. Furthermore, the metal matrix nanocomposite herein can be made by electrodeposition.

According to an embodiment, a method for coating a substrate includes disposing a deposition composition in a container. The deposition composition includes a plurality of nanosheets and metal ions. The metal ions are the same or different species. The method also includes disposing a substrate in the container, contacting the substrate with the deposition composition, biasing the substrate at potential relative to the second electrode (an anode), electrodepositing on the substrate a coating comprising a metal from the metal ions and the nanosheets in response to biasing the substrate at the first potential.

Figure 1:
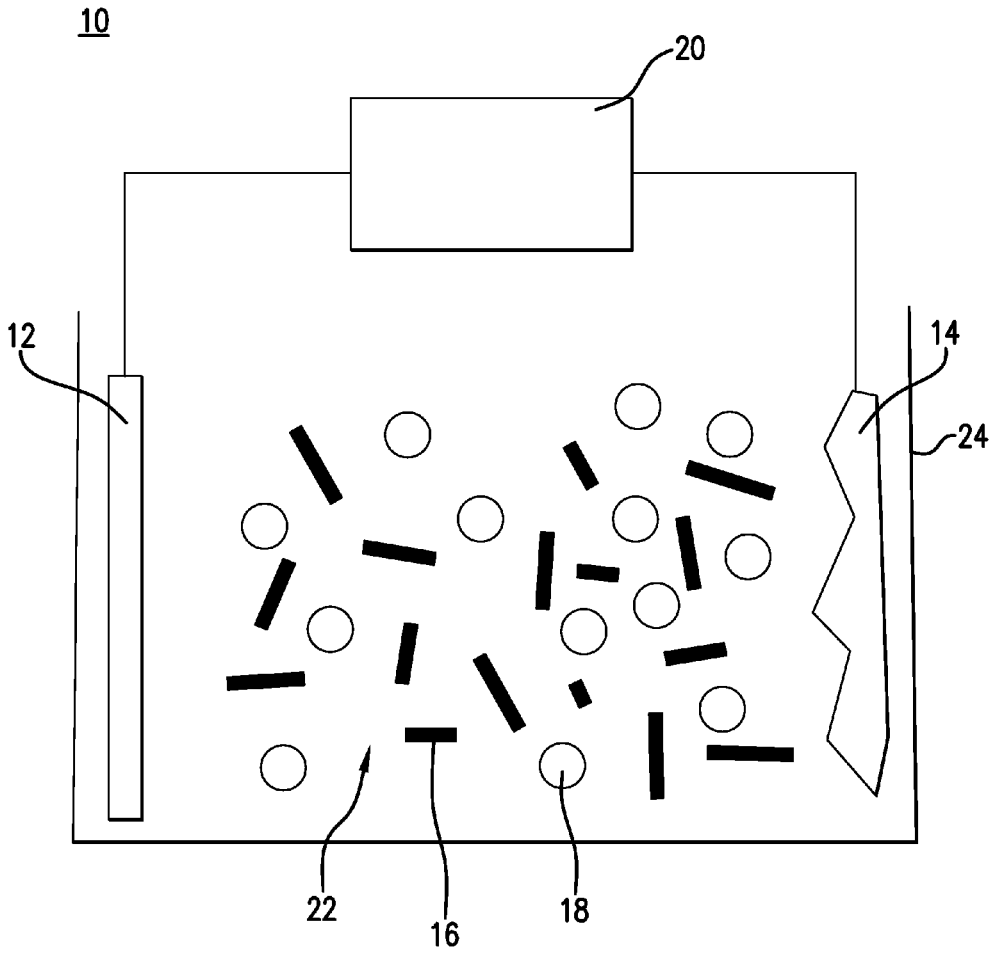
FIG. 1 shows a set up for electrodeposition of nanosheets and a metal on a substrate.

Thus, as shown in FIG. 1, in an electrodeposition configuration 10, a substrate 14 (cathode) is disposed in a container 24 and electrically connected to a power supply 20. A deposition composition 22 having nanosheets 16 and metal ions 18 is disposed in the container 24. According to an embodiment, the electrodeposition configuration 10 includes an anode 12 connected to the power supply 20. The voltage is applied between the anode 12 and the cathode 14 so that the potential of the cathode 14 is lower than the potential of the anode 12. Under such an applied voltage, the nanosheets 16 and a metal from the metal ions 18 in the deposition composition deposit on the substrate 14 to form a coating (not shown).

The deposition composition is a source of the nanosheets and the metal in the coating. In an embodiment, the metal ions provide a source of the metal deposited on the substrate. The metal ions originate from a compound that contains a metal such that the metal in the compound is reduced to give the elemental metal. The compound includes covalent compounds of the metal, ionic compounds of the metal, metal complexes, and the like. Exemplary metal materials are $AlCl_3$, $NiCl_2$, $NiSO_4$, $CoSO_4$, $Ni((C_6H_5)_3P)_2(SCN)_2$, $Ni((C_6H_5)_3P)_2(NO_3)_2$, $Ni(NH_2CH_2CH_2NH_2)_2(NO_3)_2$, $Ni(NH_2CH_2CH_2NH_2)_2(NO_3)I$, $Co((C_6H_5)_3PO)_2(NO_3)_2$, $Co(NH_3)_4(CO_3)(NO_3)$, $Ni(C_5H_5N)_3(NO_3)_2$, $Co(C_5H_5N)_3(NO_3)_2$, $Cu(NO_3)_2$, $AuCl_3$, and the like. In the ionic compounds, the anion can be a halide (e.g., fluoride, chloride, bromide, and the like), sulfate, sulfite, sulfamate, acetate, nitrate, hydroxide, cyanide, chromate, carbonate, phosphate, ammonium, perchlorate, and the like. Moreover, upon reduction, the metal released from the metal material and deposited on the substrate with the nanosheets includes Al, Co, Ni, Cu, Ag, Au, Cr, Fe, Pb, Pd, Pt, Rh, Ru, Sn, Ti, V, W, Zn, or a combination thereof.

In an embodiment, the anode includes a same metal as the metal produced from reduction of the metal ion. During deposition of the metal and nanosheets on the substrate, the anode releases the metal into the deposition composition so that the amount of the metal (or metallic species) in the deposition composition is not depleted. According to an embodiment, additional metal (e.g., metal cations) from an external source (e.g., a metal material source such as a metering pump, flow meter, etc.) is disposed in the deposition composition to establish a constant (or varying) concentration of the metal in the deposition composition as the metal material is consumed in the deposition process to form the coating.

Nanosheets, from which the coating is formed, are particles having an average size, in at least one dimension, of less than one micrometer (μm). As used herein "average size" refers to the number average size based on the at least one linear dimension of the particle. According to an embodiment, the nanosheets have a dimension that is less than or equal to 750 nm, specifically 500 nm, more specifically 250 nm, even more specifically 100 nm, and further specifically 20 nm. In an embodiment, the nanosheets have a dimension from 1 nm to 500 nm, in another embodiment from 1 nm to 250 nm, in another embodiment from 1 nm to 100 nm, and in another embodiment from 1 nm to 75 nm. The particle size of the nanosheet with respect to its longest dimension (also referred to as major axis) is greater than or equal to 100 nm, specifically 500 nm, more specifically 1 μm, even more specifically 5 μm, and yet more specifically 10 μm. The aspect ratio (i.e., the ratio of the smallest dimension to the largest dimension) of the nanosheets is from 1 to 10,000, specifically from 1 to 5,000, and more specifically from 1 to 500. The nanosheets are monodisperse, where all particles are of the same size with little variation, or polydisperse, where the particles have a range of sizes and are averaged. Generally, polydisperse nanosheets are used. In another embodiment, nanosheets of different average particle sizes are used, and in this way, the particle size distribution of the nanosheets is unimodal (exhibiting a single distribution), bimodal exhibiting two distributions, or multi-modal, exhibiting more than one particle size distribution.

The nanosheets used to form the coating include graphene, graphene oxide, a metal oxide, a metal nitride, or a combination thereof. In an embodiment, the nanosheets are graphene. The graphene is a two-dimensional particle of nominal thickness, having one or more than one layer of fused hexagonal rings with an extended delocalized π-electron system. Where more than one graphene layer is present, the layers are weakly bonded to one another through π-π stacking interaction. Graphene is thus a single sheet or a stack of several sheets having both micro- and nano-scale dimensions. In some embodiments, graphene has an average particle size of 1 to 20 μm, in another embodiment 1 to 15 μm, and an average thickness (smallest) dimension in nanoscale dimensions of less than or equal to 50 nm, in an embodiment less than or equal to 25 nm, and in another embodiment less than or equal to 10 nm. An exemplary graphene has an average particle size of 1 to 5 μm, and in an embodiment 2 to 4 μm. In a specific embodiment, the nanosheet is a derivatized graphene.

Graphene is prepared by, for example, exfoliation of graphite or by a synthetic procedure by "unzipping" a nanotube to form a graphene ribbon, followed by derivatization to prepare graphene oxide.

Exfoliation to form graphene is carried out by exfoliation of a graphite source such as graphite, intercalated graphite, and nanographite. Exemplary exfoliation methods include fluorination, acid intercalation, acid intercalation followed by high temperature treatment, and the like, or a combination thereof. Exfoliation of nanographite provides a graphene having fewer layers than non-exfoliated nanographite. It will be appreciated that exfoliation of nanographite may provide the graphene as a single sheet only one molecule thick, or as a layered stack of relatively few sheets. In an embodiment, exfoliated graphene has fewer than 50 single sheet layers, in an embodiment fewer than 20 single sheet layers, in another embodiment fewer than 10 single sheet layers, and in another embodiment fewer than 5 single sheet layers.

Graphene oxide is formed, e.g., by oxidizing graphite to form graphite oxide, which is subsequently subjected to ultrasonic vibrations. Alternatively, commercially available graphene oxide may be used.

In an embodiment, the nanosheets are a metal or metalloid oxide such as silica, alumina, titania, tungsten oxide, iron oxide, a combination thereof, or the like; a metal or metalloid carbide such as tungsten carbide, silicon carbide, boron carbide, or the like; a metal or metalloid nitride such as titanium nitride, boron nitride, silicon nitride, or the like; or a combination comprising at least one of the foregoing.

According to an embodiment, the nanosheets are derivatized to include a variety of different functional groups such as, for example, carboxy (e.g., carboxylic acid groups), epoxy, ether, ketone, amine, hydroxy, alkoxy, alkyl, aryl, aralkyl, alkaryl, lactone, functionalized polymeric or oligomeric groups, and the like. In an embodiment, the nanosheets include a combination of derivatized nanosheets and underivatized nanosheets.

According to an embodiment, the nanosheets are derivatized to include a functional group that is hydrophilic, hydrophobic, oxophilic, lipophilic, or oleophilic to provide a balance of desirable properties.

In an exemplary embodiment, the nanosheets are derivatized by, for example, amination to include amine groups, where amination may be accomplished by nitration followed by reduction, or by nucleophilic substitution of a leaving group by an amine, substituted amine, or protected amine, followed by deprotection as necessary. In another embodiment, the nanosheets are derivatized by oxidative methods to produce an epoxy, hydroxy group or glycol group using a peroxide, or by cleavage of a double bond by for example a metal mediated oxidation such as a permanganate oxidation to form ketone, aldehyde, or carboxylic acid functional groups.

Where the functional groups are alkyl, aryl, aralkyl, alkaryl, functionalized polymeric or oligomeric groups, or a combination of these groups, the functional groups are attached through intermediate functional groups (e.g., carboxy, amino) or directly to the derivatized nanosheet by: a carbon-carbon bond without intervening heteroatoms, to provide greater thermal and/or chemical stability to the derivatized nanosheet, as well as a more efficient synthetic process requiring fewer steps; by a carbon-oxygen bond (where the nanosheet contains an oxygen-containing functional group such as hydroxy or carboxylic acid); or by a carbon-nitrogen bond (where the nanosheet contains a nitrogen-containing functional group such as amine or amide). In an embodiment, the nanosheets are derivatized by metal mediated reaction with a C6-30 aryl or C7-30 aralkyl halide (F, Cl, Br, I) in a carbon-carbon bond forming step, such as by a palladium-mediated reaction such as the Stille reaction, Suzuki coupling, or diazo coupling, or by an organocopper coupling reaction.

In another embodiment, a nanosheet, e.g., graphene, is directly metallated by reaction with, e.g., an alkali metal such as lithium, sodium, or potassium, followed by reaction with a C1-30 alkyl or C7-30 alkaryl compound with a leaving group such as a halide (Cl, Br, I) or other leaving group (e.g., tosylate, mesylate, etc.) in a carbon-carbon bond forming step. The aryl or aralkyl halide, or the alkyl or alkaryl compound, may be substituted with a functional group such as hydroxy, carboxy, ether, or the like. Exemplary groups include, for example, hydroxy groups, carboxylic acid groups, alkyl groups such as methyl, ethyl, propyl, butyl, pentyl, hexyl, octyl, dodecyl, octadecyl, and the like; aryl groups including phenyl and hydroxyphenyl; alkaryl groups such as benzyl groups attached via the aryl portion, such as in a 4-methylphenyl, 4-hydroxymethylphenyl, or 4-(2-hydroxyethyl)phenyl (also referred to as a phenethylalcohol) group, or the like, or aralkyl groups attached at the benzylic (alkyl) position such as found in a phenylmethyl or 4-hydroxyphenyl methyl group, at the 2-position in a phenethyl or 4-hydroxyphenethyl group, or the like. In an exemplary embodiment, the derivatized nanosheet is graphene substituted with a benzyl, 4-hydroxybenzyl, phenethyl, 4-hydroxyphenethyl, 4-hydroxymethylphenyl, or 4-(2-hydroxyethyl)phenyl group, or a combination thereof.

In one embodiment, the nanosheet is further derivatized by grafting certain polymer chains to the functional groups. For example, polymer chains such as acrylic chains having carboxylic acid functional groups, hydroxy functional groups, or amine functional groups; polyamines such as polyethyleneamine or polyethyleneimine; poly(alkylene glycols) such as poly(ethylene glycol) or poly(propylene glycol); and the like are included by reaction with functional groups. According to an embodiment, the nanosheet is graphene derivatized to have metal atoms connected thereto.

In an embodiment, the nanosheets have an anionic functional group such as a sulfonic acid group, carboxyl group, phosphoric acid group, phosphorous acid group, phosphinic acid group, or a combination thereof. When the nanosheets are functionalized with an anionic group, they also include a cationic functional group, wherein a number of cationic functional groups is larger than a number of anionic functional groups such that the nanosheets have a positive charge and move toward the cathode. In another embodiment, the nanosheets have a basic or cationic functional group. The basic functional group is, for example, a primary amino group, secondary amino group, tertiary amino group, or a combination thereof. The cationic functional group is, for example, a quaternary ammonium group, quaternary phosphonium group, tertiary sulfonium group, alkyl pyridinium group, or a combination thereof. In an embodiment, the nanosheets have a cationic functional group containing a primary amine (—$NH_2$), secondary amine (—NHR, where R may be, for example, an alkyl or aryl group), tertiary amine (—$NR_2$, where each R may be the same or different group, for example an alkyl or aryl group), or combination thereof. Examples of such functional groups include aminoethyl, dimethylaminoethyl, diethylaminoethyl, and similar groups. The nanosheets with the cationic functional group include a counter ion (host ion) associated with the cationic functional group such as hydroxide, halide, sulfate, and the like.

Where the nanosheet is carbon-based such as graphene, the degree of functionalization varies from 1 functional group for every 5 carbon centers to 1 functional group for every 100 carbon centers, depending on the functional group, and the method of functionalization.

In an embodiment, the nanosheets have an ionic polymer disposed on the surface of the nanoparticle. The ionic polymer is a reaction product of an ionic liquid that includes a cation and an anion. The reaction that produces the reaction product is, for example, polymerization of monomers of the ionic liquid.

In the deposition composition, the nanosheets and metal material are disposed in a liquid so that the deposition composition is an aqueous or nonaqueous fluid. For the aqueous fluid, the liquid is water, an alcohol (monohydric such a C1-C4 alcohol or polyhydric such as glycols), a carboxylic acid (e.g., formic acid, acetic acid, and the like), and the like, or a combination thereof.

Ionic liquids are liquids that are almost exclusively ions. Ionic liquids differ from so-called molten salts in that molten salts are typically corrosive and require extremely high temperatures to form a liquid due to ionic bond energies between the ions in the salt lattice. For example, the melting temperature of the face-centered cubic crystal sodium chloride is greater than 800° C. In comparison, many ionic liquids are liquid below 100° C.

According to an embodiment, the ionic liquid has a cation of formula (I) to formula (14):

Formula (1)

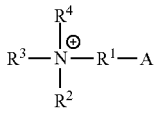

Formula (2)

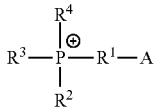

Formula (3)

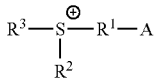

Formula (4)

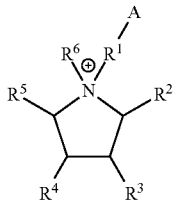

Formula (5)

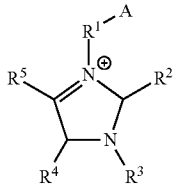

Formula (6)

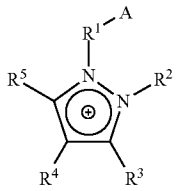

Formula (7)

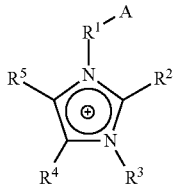

Formula (8)

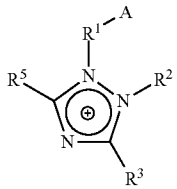

Formula (9)

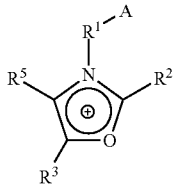

-continued

Formula (10)

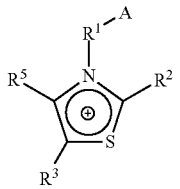

Formula (11)

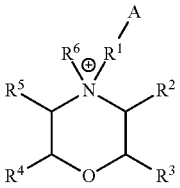

Formula (12)

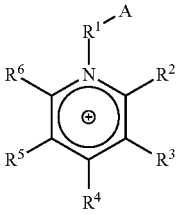

Formula (13)

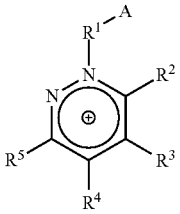

Formula (14)

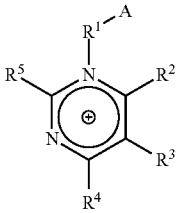

Formula (15)

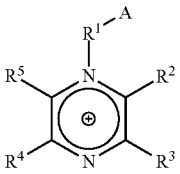

wherein A is hydrogen, an alkyl group, hydroxy, an amine, an alkoxy, an alkenyl group, or a polymerizable group; $R^1$ is a bond (e.g., a single bond, double bond, and the like) or any biradical group such as alkylene, alkyleneoxy, cycloalkylene, alkenylene, alkynylene, arylene, aralkylene, aryleneoxy, which is unsubstituted or substituted with a heteroatom or halogen; $R^2$, $R^3$, $R^4$, $R^5$, and $R^6$ are independently hydrogen, alkyl, alkyloxy, cylcloalkyl, aryl, alkaryl, aralkyl, aryloxy, aralkyloxy, alkenyl, alkynyl, amine, alkyleneamine, aryleneamine, hydroxy, carboxylic acid group or salt, halogen, which is unsubstituted or substituted with a heteroatom or halogen.

In an embodiment, the polymerizable group A includes an α,β-unsaturated carbonyl group (e.g., an acryl group or methacryl group), α,β-unsaturated nitrile group, alkenyl group (e.g., a conjugated dienyl group), alkynyl group, vinyl carboxylate ester group, carboxyl group, carbonyl group, epoxy group, isocyanate group, hydroxyl group, amide group, amino group, ester group, formyl group, nitrile group, nitro group, or a combination comprising at least one of the foregoing.

It is contemplated that ionic liquids with polymerizable group A are used to provide a positive charge to the nanosheets through, e.g., covalent modification of the nanosheets with the ionic liquid or by polymerization of the ionic liquid on the surface of the nanosheets. In some embodiments, deposition of a coating includes using the ionic liquid to supply positive charge to the nanosheets without involving protons. Moreover, such binding provides stability to the deposited coatings because the nanosheets modified by the ionic liquid anchor and support metal nanoparticles. In some embodiments, the ionic liquid is used as an aprotic non-aqueous solvent without the A group being the polymerizable group, e.g., A is hydrogen. Without wishing to be bound by theory, polymerization of the ionic liquid increases its viscosity and decreases its cationic mobility. Thus, in some embodiments, the polymerizable ionic liquids are used to supply positive charge to the nanosheets, e.g., for surface treatment of the nanosheets, and in some embodiments, non-polymerizable ionic liquids are used as a solvent.

According to an embodiment, the cation of the ionic liquid includes imidazolium, pyrazolium, pyridinium, ammonium, pyrrolidinium, sulfonium, phosphonium, morpholinium, derivatives thereof, or a combination comprising at least one of the foregoing.

The anion of the liquid ion is not particularly limited as long as the anion does not interfere with polymerization of the ionic liquid or dispersal of the nanoparticles. Non-limiting examples of the anion are halide (e.g., fluoride, chloride, bromide, iodide), tetrachloroaluminate ($AlCl_4^-$), hexafluorophosphate ($PF_6^-$), hexafluoroarsenate ($AsF_6^-$), tetrafluoroborate ($BF_4^-$), triflate ($CF_3SO_3^-$), mesylate ($CH_3SO_3^-$), dicyanamide ($(NC)_2N^-$), thiocyanate ($SCN^-$), alkylsulfate ($ROSO_3^-$, where R is a halogentated or non-halogenated linear or branched alkyl group, e.g., $CH_3CH_2OSO_3^-$), tosylate, bis(trifluoromethyl-sulfonyl) imide, alkyl sulfate ($ROSO_3^-$, where R is a halogentated or non-halogenated linear or branched alkyl group, e.g., $CF_2HCH_2OSO_3^-$), alkyl carbonate ($ROCO_2^-$, where R is a halogentated or non-halogenated linear or branched alkyl group), or a combination comprising at least one of the foregoing.

In a specific embodiment, the ionic liquid has a cation of formula 7 with A being an alkenyl group, R1 being a bond or bivalent radical, and R2 to R5 being an alkyl group or hydrogen; and an anion that is tetrafluoroborate. Particularly, the ionic liquid has a cation of formula 7 with A being an alkenyl group, R1 being a bond or bivalent radical, R3 being an alkyl group, and R2, R4, and R5 being hydrogen; and an anion that is tetrafluoroborate.

Examples of the ionic liquid include but are not limited to 3-ethyl-1-vinylimidazolium tetrafluoroborate, 1-methyl-3-vinylimidazolium methyl carbonate, 1-isobutenyl-3-methylimidazolium tetrafluoroborate, 1-allyl-3-methylimidazolium bis(trifluoromethylsulfonyl)imide, 1-allyl-3-methylimidazolium bromide, 1,3-bis(cyanomethyl)imidazolium bis(trifluoromethylsulfonyl)imide, 1-ethyl-nicotinic acid ethyl ester ethylsulfate, 1-butyl-nicotinic acid butyl ester bis[(trifluoromethyl)sulfonyl]imide, 1-(3-cyanopropyl)-3-methylimidazolium bis(trifluoromethylsulfonyl)amide, 1,3-diallylimidazolium bis(trifluoromethylsulfonyl)imide, ethyl-dimethyl-(cyanomethyl)ammonium bis(trifluoromethyl sulfonyl)imide, 3-[4-(acryloyloxy)butyl]-1-methyl-1H-imidazol-3-ium hexafluorophosphate, 1-methyl-3-{3-[(2-methylacryloyl)oxy]propyl}-1H-imidazol-3-ium bromide, and 3-ethenyl-1-ethyl-1H-imidazol-3-ium bis(trifluoromethylsulfonyl)imide. According to an embodiment, the ionic liquid that is used as a solvent includes aluminum chloride-1-ethyl-3-methylimidazolium chloride ($AlCl_3$-EMIC); aluminum chloride-N-(n-butyl)pyridinium chloride ($AlCl_3$-BPC); 1-butyl-1-methylpyrrolidinium bis(trifluoromethylsulfonyl)amide (BMPTFSA); 1-butyl-3-methylimidazolium chloride; 1-butyl-3-methylimidazolium bis(trifluoromethylsulfonyl)imide; 1-butyl-3-methylimidazolium dicyanamide and the like.

In an embodiment, the ionic liquid is a solvent in the nonaqueous fluid form of the deposition composition. In an embodiment, the ionic liquid is used to form an ionic polymer on the nanosheets. In some embodiments, the ionic liquid is a solvent in electrodeposition of a non-noble metal. For the non-noble metal aluminum, since hydrogen gas evolves at a higher potential than a deposition potential of aluminum and its alloys, electrodeposition of aluminum in an aqueous solution is largely infeasible. However, the ionic liquid herein provides electrodeposition of such non-noble metals in a controlled manner.

The ionic liquid can be obtained commercially, for example, from Sigma Aldrich or is synthetically prepared. Exemplary syntheses include reacting an alkyl tertiary amine having a polymerizable group with an alkyl halide to obtain quaternarization of a nitrogen then performing an exchange reaction with a desired anion. Alternatively, by reacting, for example, a tertiary amine with methyl p-tosylate, the anion can be concurrently introduced with quaternarization. A further alternative synthesis includes, for example, reacting a compound such as 2-chloroethanol with an N-alkylimidazole or pyridine to form an imidazolium salt or a pyridinium salt, reacting the salt with (meth)acryloyl chloride, and performing an exchange reaction with a desired anion. Yet another alternative is reacting an N-alkylimidazole or pyridine with 2-((meth)acryloylethyl) chloride and then carrying out an exchange reaction with a desired anion.

According to an embodiment, the nanosheets, the metal material, and the ionic liquid are combined to form the deposition composition.

In an embodiment, the deposition composition further includes a buffer, a surfactant, solvent, or a combination thereof. The buffer is included to control the pH of the deposition composition or to mediate the pH during the formation or deposition of the coating. Moreover, it is contemplated that the solubility of the metal formed from the metal material of the deposition composition depends on the pH of the deposition composition. Exemplary buffers are alkali salts of weak acids such as formic acid, acetic acid, citric acid, and the like; sulfonic acids; boric acid; and the like. In an embodiment, the deposition composition is aqueous and has a pH less than or equal to 7, in another embodiment less than or equal to 6, in another embodiment less than or equal to 5, and in another embodiment from 2 to 6, and specifically from 3 to 5.

The surfactant is included in the deposition composition to disperse the nanosheets among the metal material. Useful surfactants include fatty acids of up to 22 carbon atoms such as stearic acids and esters and polyesters thereof, poly(alkylene glycols) such as poly(ethylene oxide), poly(propylene oxide), and block and random poly(ethylene oxide-propylene oxide) copolymers such as those marketed under the trademark PLURONIC by BASF. Other surfactants include polysiloxanes, such as homopolymers and copolymers of poly(dimethylsiloxane), including those having functionalized end groups, and the like. Other useful surfactants include those having a polymeric dispersant having poly(alkylene glycol) side chains, fatty acids, or fluorinated groups such as perfluorinated $C_{1-4}$ sulfonic acids grafted to the polymer backbone. Polymer backbones include those based on a polyester, a poly(meth)acrylate, a polystyrene, a poly(styrene-(meth)acrylate), a polycarbonate, a polyamide, a polyimide, a polyurethane, a polyvinyl alcohol, or a copolymer comprising at least one of these polymeric backbones. Additionally, the surfactant can be anionic, cationic, zwitterionic, or non-ionic.

Exemplary cationic surfactants include but are not limited to alkyl primary, secondary, and tertiary amines, alkanolamides, quaternary ammonium salts, alkylated imidazolium, and pyridinium salts. Additional examples of the cationic surfactant include primary to tertiary alkylamine salts such as, for example, monostearylammonium chloride, distearylammonium chloride, tristearylammonium chloride; quaternary alkylammonium salts such as, for example, monostearyltrimethylammonium chloride, distearyldimethylammonium chloride, stearyldimethylbenzylammonium chloride, monostearyl-bis(polyethoxy)methylammonium chloride; alkylpyridinium salts such as, for example, N-cetylpyridinium chloride, N-stearylpyridinium chloride; N,N-dialkylmorpholinium salts; fatty acid amide salts such as, for example, polyethylene polyamine; and the like.

Exemplary anionic surfactants include alkyl sulfates, alkyl sulfonates, fatty acids, sulfosuccinates, and phosphates. Examples of an anionic surfactant include anionic surfactants having a carboxyl group such as sodium salt of alkylcarboxylic acid, potassium salt of alkylcarboxylic acid, ammonium salt of alkylcarboxylic acid, sodium salt of alkylbenzenecarboxylic acid, potassium salt of alkylbenzenecarboxylic acid, ammonium salt of alkylbenzenecarboxylic acid, sodium salt of polyoxyalkylene alkyl ether carboxylic acid, potassium salt of polyoxyalkylene alkyl ether carboxylic acid, ammonium salt of polyoxyalkylene alkyl ether carboxylic acid, sodium salt of N-acylsarcosine acid, potassium salt of N-acylsarcosine acid, ammonium salt of N-acylsarcosine acid, sodium salt of N-acylglutamic acid, potassium salt of N-acylglutamic acid, ammonium salt of N-acylglutamic acid; anionic surfactants having a sulfonic acid group; anionic surfactants having a phosphonic acid; and the like.

The nonionic surfactant can be, e.g., ethoxylated fatty alcohols, alkyl phenol polyethoxylates, fatty acid esters, glycerol esters, glycol esters, polyethers, alkyl polyglycosides, amineoxides, or a combination thereof. Exemplary nonionic surfactants include fatty alcohols (e.g., cetyl alcohol, stearyl alcohol, cetostearyl alcohol, oleyl alcohol, and the like); polyoxyethylene glycol alkyl ethers (e.g., octaethylene glycol monododecyl ether, pentaethylene glycol monododecyl ether, and the like); polyoxypropylene glycol alkyl ethers (e.g., butapropylene glycol monononyl ether); glucoside alkyl ethers (e.g., decyl glucoside, lauryl glucoside, octyl glucoside); polyoxyethylene glycol octylphenol ethers (e.g., Triton X-100 (octyl phenol ethoxylate)); polyoxyethylene glycol alkylphenol ethers (e.g., nonoxynol-9); glycerol alkyl esters (e.g., glyceryl laurate); polyoxyethylene glycol sorbitan alkyl esters (e.g., polysorbates such as sorbitan monolaurate, sorbitan monopalmitate, sorbitan monostearate, sorbitan tristearate, sorbitan monooleate, and the like); sorbitan alkyl esters (e.g., polyoxyethylene sorbitan monolaurate, polyoxyethylene sorbitan monopalmitate, polyoxyethylene sorbitan monostearate, polyoxyethylene sorbitan monooleate, and the like); cocamide ethanolamines (e.g., cocamide monoethanolamine, cocamide diethanolamine, and the like); amine oxides (e.g., dodecyldimethylamine oxide, tetradecyldimethylamine oxide, hexadecyl dimethylamine oxide, octadecylamine oxide, and the like); block copolymers of polyethylene glycol and polypropylene glycol (e.g., poloxamers available under the trade name Pluronics, available from BASF); polyethoxylated amines (e.g., polyethoxylated tallow amine); polyoxyethylene alkyl ethers such as polyoxyethylene stearyl ether; polyoxyethylene alkylene ethers such as polyoxyethylene oleyl ether; polyoxyalkylene alkylphenyl ethers such as polyoxyethylene nonylphenyl ether; polyoxyalkylene glycols such as polyoxypropylene polyoxyethylene glycol; polyoxyethylene monoalkylates such as polyoxyethylene monostearate; bispolyoxyethylene alkylamines such as bispolyoxyethylene stearylamine; bispolyoxyethylene alkylamides such as bispolyoxyethylene stearylamide; alkylamine oxides such as N,N-dimethylalkylamine oxide; and the like Zwitterionic surfactants (which include a cationic and anionic functional group on the same molecule) include, for example, betaines, such as alkyl ammonium carboxylates (e.g., $[(CH_3)_3N^+—CH(R)COO^-]$ or sulfonates (sulfo-betaines) such as $[RN^+(CH_3)_2(CH_2)_3SO_{3-}]$, where R is an alkyl group). Examples include n-dodecyl-N-benzyl-N-methylglycine $[C_{12}H_{25}N^+(CH_2C_6H_5)(CH_3)CH_2COO^-]$, N-allyl N-benzyl N-methyltaurines $[C_nH_{2n+1}N^+(CH_2C_6H_5)(CH_3)CH_2CH_2SO_3^-]$.

The solvent is an aqueous solvent or an organic solvent. The aqueous solvent is, e.g., water. The organic solvent includes an alcohol (e.g., methanol, ethanol, isopropanol, and the like), dimethylsulfone, acetone, an acetate, dimethsulfoxide, dimethylformamide, γ-butyrolactone, tetrahydrofuran, propylene carbonate, ethylene glycol, an ether, an aromatic solvent (e.g., benzene, toluene, p-xylene, ethylbenzene, and the like), or a combination comprising at least one of the foregoing. The solvent is selected based on the constituents of the deposition composition.

In addition to the metal material and the nanosheets, the deposition composition includes a reducing agent in some embodiments. The reducing agent is present to reduce, e.g., metal cations from the metal material to produce the metal, e.g., during deposition of the metal on the substrate in electroless deposition.

The substrate is typically biased with an electrical potential for depositing the metal and nanosheets thereon. The substrate is electrically conductive or electrically nonconductive. Electrically conductive substrates include metals and alloys or composites thereof. Exemplary metals include aluminum, bismuth, boron, calcium, cobalt, copper, chromium, iron, lead, magnesium, manganese, molybdenum, nickel, niobium, nitrogen, phosphorous, selenium, sulfur, tantalum, tellurium, titanium, tungsten, vanadium, zirconium, silicon, zinc, a rare earth element, or a combination thereof. Exemplary alloys include nickel-cobalt, ferrous alloys, magnesium alloys (e.g., Mg—Al alloys, MgZrZn, MgAlZn, and the like), aluminum alloys, and the like.

In an embodiment, the substrate is electrically nonconductive and is, e.g., a polymer, ceramic, or glass. Here, the electrically nonconductive substrate includes a strike layer comprising an electrically conductive material, e.g., a metal, disposed on a surface of the electrically nonconductive substrate. The strike layer covers all or a portion of the substrate.

The substrate is any shape (e.g. planar, round, a mesh, polygonal, rectangular, annular, and the like), and is smooth or has an edge such as a corner, break, hole, pore, and the like. In some embodiments, the anode has a shape that complements the substrate to mediate the current density and thus coating thickness. In an embodiment, the anode has a different shape than the substrate.

In an embodiment, the nanosheets are present in the deposition composition in an amount from 0.001 wt % to 10 wt %, specifically from 0.1 wt % to 10 wt %, and more specifically from 0.1 wt % to 5 wt %, based on the weight of the nanosheets and the metal material in the deposition composition. The nanosheets are present in the coating in an amount from 0.001 wt % to 10 wt %, specifically from 0.1 wt % to 10 wt %, and more specifically from 0.1 wt % to 5 wt %, based on the weight of the nanosheets and the metal in the coating. In an embodiment, a ratio of a number of moles of the metal material to a number of moles of the ionic liquid in the deposition composition is greater than or equal to 1, specifically greater than or equal to 1.5, and more specifically greater than or equal to 3.

Additives such as the buffer, surfactant, reducing agent and the like are present in the deposition composition in an amount from 0 wt % to 20 wt %, specifically 0 wt % to 10 wt %, and more specifically 0 wt % to 5 wt %, based on the weight of the deposition composition.

The metal is present in the coating in an amount from 80 wt % to 99.999 wt %, specifically from 90 wt % to 99.9 wt %, and more specifically from 95 wt % to 99.9 wt %, based on the weight of the nanosheets and the metal in the coating.

To form the coating on the substrate, the metal is produced from reduction of the metal material by application of a voltage. According to an embodiment, the deposition of the coating on the substrate is electroless where an anode is not present. Here, the deposition composition additionally includes the reducing agent, e.g., to reduce the cationic metal species in the metal material for deposition of the metal on the substrate. In another embodiment, the anode is present but the first potential and the second potential are the same or their difference is below a potential at which reduction of the metal cation occurs so that reduction of the metal cation occurs in the decomposition composition between the metal material and the reducing agent.

In an embodiment, the applied voltage is a direct current (DC) voltage. In some embodiments, the applied voltage is a pulsed voltage. This potential difference is great enough to reduce the metal material to produce the metal to be deposited on the substrate. According to an embodiment, the potential difference is selected based on the metal to be produced in the reduction, e.g., 1.5 volts (V) for the $Ni^{2+}$ from the metal material $NiCl_2$ to produce elemental nickel as in the half-reaction $Ni^{2+}+2e-\rightarrow Ni^0$. In an embodiment, the potential difference is from 0 V to 100 V, specifically 0 V to 50 V, more specifically 0 V to 10 V, even more specifically 0 V to 5 V, and yet more specifically 0 V to 2 V. The current density at the substrate is from 0.5 amps per square decimeter ($A/dm^2$) to 100 $A/dm^2$, specifically 0.5 $A/dm^2$ to 50 $A/dm^2$ and more specifically 1 $A/dm^2$ to 20 $A/dm^2$. In an embodiment, the current density is from 20 $A/dm^2$ to 50 $A/dm^2$ for the nonaqueous fluid.

In an embodiment, the applied voltage is pulsed, and the pulsing is synchronously or asynchronously. Further, the pulse width is 500 ns to infinity (i.e., continuous), specifically 500 ns to 30 seconds, more specifically 500 ns to 1 second, and even more specifically 1 μs to 1 second. The pulse frequency is from 0.1 hertz (Hz) to 100 megahertz (MHz), specifically 1 Hz to 20 MHz, and more specifically 10 Hz to 10 (kilohertz) kHz. In an embodiment, the pulsed current density therefore is from 0.5 amps per square decimeter ($A/dm^2$) to 100 $A/dm^2$, specifically 0.5 $A/dm^2$ to 50 $A/dm^2$ and more specifically 1 $A/dm^2$ to 20 $A/dm^2$. In an embodiment, the polarity of the first potential is positive or negative with respect to the second potential (i.e., the bias at the anode). According to an embodiment, the applied voltage can be pulsed between a non-zero and a zero value or between two non-zero values of opposite polarities. In an embodiment, an equal number of positive and negative voltage pulses are used in a given cycle during pulsing of the first potential. The pulse shape of the pulsed potentials (first potential or second potential) is constant (i.e., no pulse), square (or rectangular), triangular, sawtooth, sinusoidal, and the like. The duty cycle of the first potential or the second potential is from 0.1% to 100%, specifically 1% to 75%, more specifically 1% to 50%, and even more specifically 5% to 50%.

In an embodiment, a reference electrode is disposed in the container. Additionally, a suitable pH monitor (e.g., an electronic pH monitor, litmus paper, an acid-base indicator, and the like) is used to monitor the pH of the deposition composition. The temperature of the electrodeposition configuration (e.g., as in FIG. 1) is monitored or controlled via a thermocouple, resistance temperature detector, infrared detector, heating element, cooling element, and the like.

With regard to the deposition composition during deposition of the coating on the substrate, the pH is from 2 to 6, specifically 2 to 5, and more specifically 3 to 5. The temperature of the electrodeposition configuration or component thereof is from 15° C. to 90° C., specifically 20° C. to 90° C., and more specifically 20° C. to 80° C. The deposition occurs at any pressure, including atmospheric pressure, sub-atmospheric pressure (i.e., under a vacuum condition), or at greater than atmospheric pressure.

In an embodiment, during deposition of the nanosheets and metal on the substrate to form the coating, the nanosheets follow the applied electric field to the substrate. In some embodiments, the nanosheets are charged (e.g., positively charged or negatively charged) such that in a certain pH range the nanosheets have, e.g., a positive charge. Consequently, the pH of the deposition composition is changed to alter the charge density on the nanosheets or change the polarity of the charge on the nanosheets. In this manner, the density of the nanosheets in the growing coating is selectively controlled.

Figure 2:
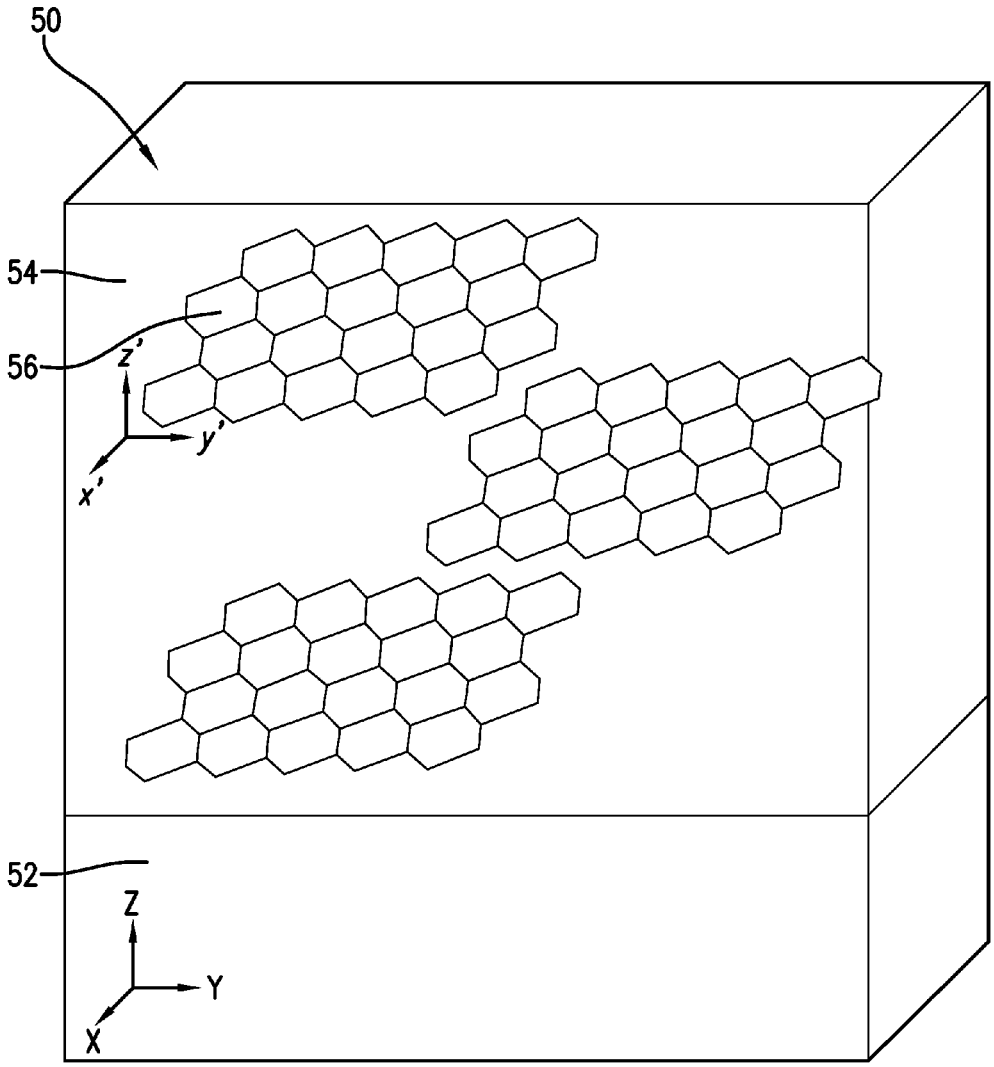
FIG. 2 shows a metal matrix nanocomposite having a parallel arrangement of nanosheets and substrate.

Because of depositing the nanosheets and metal on the substrate, a coating is formed on the substrate. As shown in FIG. 2, the coating 50 (also referred to as a metal matrix nanocomposite) includes nanosheets 56 dispersed in a matrix of metal 54. The coating is disposed on the substrate 52. The nanosheets 56 have a thickness along internal coordinate z' as shown in FIG. 2, and the substrate 52 has a thickness along internal axis Z. As indicated, the nanosheets have two in-plane axes indicated as x' and y'.

The thickness of the substrate is any thickness. In an embodiment, the thickness of the substrate is from several nanometers (nm) to several millimeters thick, specifically greater than or equal to 10 nm, more specifically greater than or equal to 1 micrometer (μm), and even more specifically greater than or equal to 20 centimeters (cm). According to an embodiment, the thickness of the coating is from 1 nm to 5 mm, specifically 10 nm to 500 μm, and more specifically 1 μm to 100 μm.

The nanosheets are uniformly or non-uniformly (e.g., distributed in a gradient distribution) distributed in the metal matrix 54. In an embodiment, the number density of the nanosheets proximate to the substrate is less than the number density distal to the substrate, with the number density of the nanosheets changing smoothly (i.e., linearly by distance from the substrate) in a gradient. According to an embodiment, the number density of the nanosheets proximate to the substrate is greater than the number density distal to the substrate, with the number density of the nanosheets changing smoothly (i.e., linearly by distance from the substrate) in a gradient. In an embodiment, where the number density of the nanosheets in the coating varies by location in the coating, the number density changes abruptly instead of smoothly, e.g., monotonically with respect to distance from the substrate or in a direction parallel to the surface of the substrate.

Above, the coating is formed on the substrate. In an embodiment, the substrate is removed from the coating to form a free-standing layer of nanosheets dispersed in a matrix of metal. Removal of the substrate includes dissolving the substrate, corroding the substrate, cutting the substrate from the coating, burning the substrate, pulling the substrate away from the coating, reacting away the substrate, and the like. According to an embodiment, the substrate is a metal foil that is dissolved, leaving the free-standing layer comprising nanosheets disposed in the metal.

Figure 3:
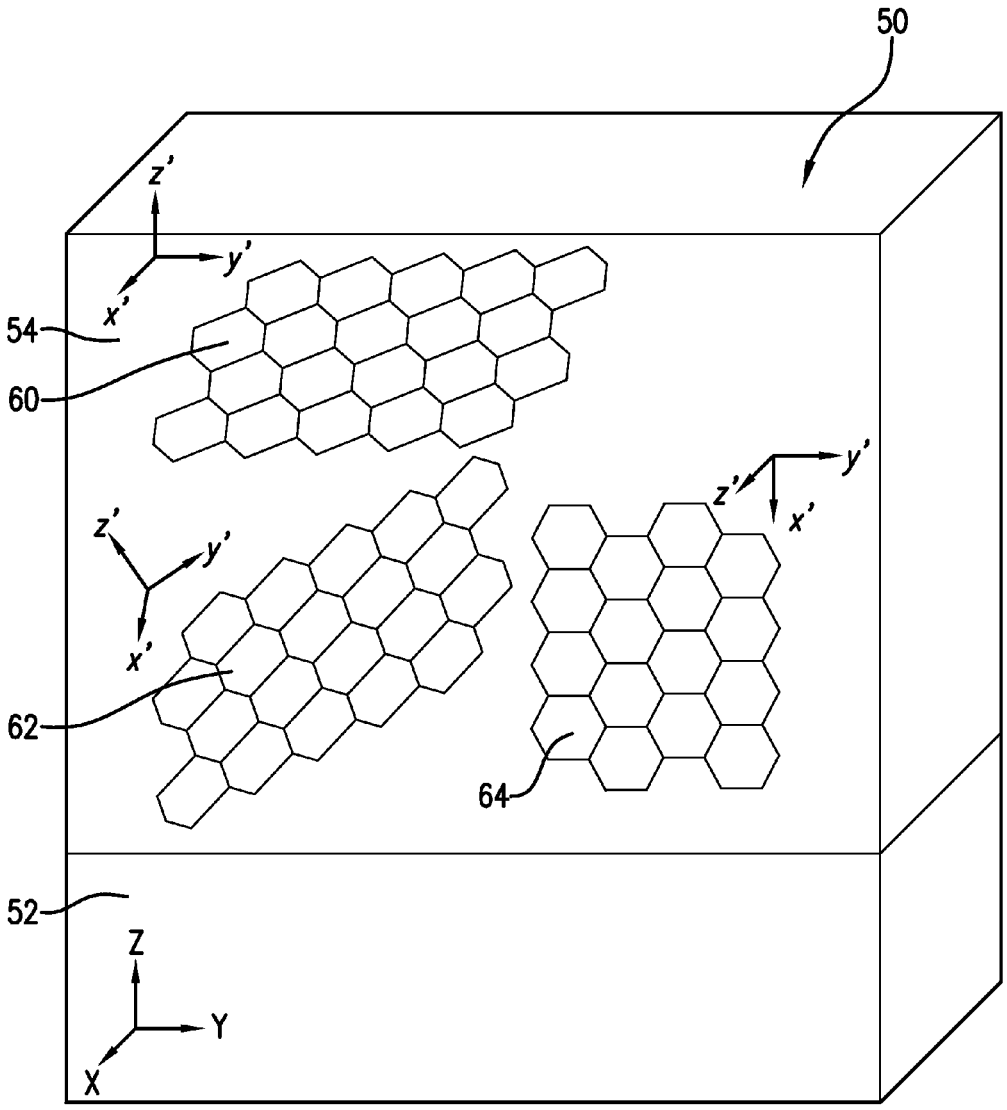
FIG. 3 shows a metal matrix nanocomposite having a plurality of orientations of nanosheets with respect to a surface of substrate.

FIG. 2 shows the coating 50 with nanosheets 56 uniformly oriented (with respect to their molecular planes indicated by the x'-y' plane) parallel with one another and the substrate 52, which has a surface in the X-Y plane, for example. In an embodiment, all of the nanosheets 56 have the same orientation of molecular planes. In some embodiments, the nanosheets 56 have various orientations, including (as shown in FIG. 3) nanosheets 60 oriented parallel to the substrate 52, nanosheets 62 oriented obliquely, or nanosheets 64 oriented perpendicular. According to an embodiment, the nanosheets have a random orientation. In an embodiment, the nanosheets have a single orientation (parallel, oblique, or perpendicular) with respect to the substrate.

According to an embodiment, during deposition of the nanosheets and the metal on the substrate, operating parameters are changed, including changing the first potential, the metal material, the plurality of nanosheet, or a combination thereof to form a plurality of different coatings on the substrate. In one embodiment, the coating is a single layer or multilayer, having a different composition of the layers in the coating. Such a multiplayer is formed, e.g., by modulating the first potential or changing the rate of deposition of a component of the coating, e.g., the nanosheets or metal.

The coating is continuous or discontinuous of variable or uniform thickness. In an embodiment, a portion of the substrate is masked so that the coating is discontinuous on the substrate and, in particular, is absent from the masked portion of the substrate. The mask is removed or remains on the substrate after formation of the coating.

The coating and the coated substrate have advantageous properties including hardness over coatings that contain only metals or metal with additives such as ceramic or non-planar shaped nanosheets. In an embodiment, the Vickers hardness is from 400HV30 to 850HV30, and specifically 500HV300 to 800HV30. Moreover, the coating provides a decreased (with respect to pure metal coating for example) coefficient of friction from 0.8 to 0.1, and specifically 0.8 to 0.2. Moreover, the coating is a robust barrier for gases and liquids, i.e., the coating shows low permeability for, e.g., sour gases or liquids, hydrocarbons, acids, bases, solvents, and the like.

In an embodiment, the coating (and an article thereof) has a compressive strength 50 kilopounds per square inch (ksi) to 150 ksi; or yield strength from 30 ksi to 100 ksi, and specifically 60 ksi to 80 ksi. In an embodiment, an article comprising the coating can include multiple components that are combined or interwork, e.g., a slip and tubular. The components of the article can have the same or different material properties, such as percent elongation, compressive strength, tensile strength, and the like.

To increase further the strength of the coating, in an embodiment, the coating is subjected to surface processing, including surface hardening. Surface hardening includes producing a surface hardened product of the coating formed in response to subjecting the coating to, e.g., carburizing, nitriding, carbonitriding, boriding, flame hardening, induction hardening, laser beam hardening, electron beam hardening, hard chromium plating, electroless nickel plating, thermal spraying, weld hardfacing, ion implantation, or a combination thereof.

The coating is applicable to numerous substrates and thus has a wide range of uses, particularly for wear applications where a substrate without the coating would otherwise be subjected to wear, erosion, corrosion, abrasion, scratching, and the like. In an embodiment, the substrate is a downhole tool, e.g., a seal, frac ball, packer, tubular, cable, drill bit, and the like.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive; rather the elements can be used separately or can be combined together under appropriate circumstances.

What is claimed is:

1. A method for coating a substrate, the method comprising:

disposing a deposition composition in a container, the deposition composition comprising:

a plurality of nanosheets, the nanosheets comprising a basic or a cationic functional group, the basic functional group comprising a primary amino group, a secondary amino group, a tertiary amino group, or a combination thereof, and the cationic functional group comprising a quaternary ammonium group, a quaternary phosphonium group, a tertiary sulfonium group, an alkyl pyridinium group, or a combination thereof; and a metal material to produce positively charged metal-containing ions in the deposition composition;

disposing a substrate in the container;

contacting the substrate with the deposition composition;

applying a voltage between the substrate and a counter electrode, the substrate being a cathode, and the counter electrode being an anode;

electrodepositing, on the substrate, a coating comprising:

a metal from the positively charged metal-containing ions; and the nanosheets, wherein the nanosheets comprise graphene, graphene oxide, or a combination comprising at least one of the foregoing.

2. The method of claim 1, further comprising disposing a reference electrode in the container.

3. The method of claim 1, wherein the metal comprises Al, Co, Ni, Cu, Ag, Au, Cr, Fe, Pb, Pd, Pt, Rh, Ru, Sn, Ti, V, W, Zn, or a combination comprising at least one of the foregoing.

4. The method of claim 1, wherein the deposition composition further comprises a buffer, a surfactant, or a combination comprising at least one of the foregoing.

5. The method of claim 1, wherein the substrate comprises aluminum, cobalt, copper, chromium, iron, lead, magnesium, manganese, molybdenum, nickel, niobium, tantalum, titanium, tungsten, vanadium, zirconium, silicon, zinc, a rare earth element, a metal alloy thereof, or a combination comprising at least one of the foregoing.

6. The method of claim 1, wherein the deposition composition is an aqueous fluid.

7. The method of claim 1, wherein the deposition composition is a nonaqueous fluid comprising an ionic liquid.

8. The method of claim 7, wherein a ratio of a number of moles of the metal material to a number of moles of the ionic liquid is greater than or equal to 1.

9. The method of claim 1, wherein the deposition composition further comprises an ionic liquid which comprises imidazolium, pyrazolium, pyridinium, ammonium, pyrrolidinium, sulfonium, phosphonium, morpholinium, a derivative thereof, or a combination comprising at least one of the foregoing.

10. The method of claim 1, wherein the nanosheets are present in the coating in an amount from 0.001 wt % to 10 wt %, based on the weight of the nanosheets and the metal in the coating.

11. The method of claim 1, wherein the voltage is a DC voltage.

12. The method of claim 1, wherein the voltage is a pulsed voltage.

13. The method of claim 1, wherein the pH of the deposition composition is from 2 to 6.

14. The method of claim 1, wherein the temperature of the deposition composition is from 15° C. to 90° C.

15. The method of claim 1, wherein the thickness of the coating is from 10 nm to 200 μm.

16. The method of claim 1, wherein the nanosheets are oriented parallel to a proximate surface of the substrate.

17. The method of claim 1, wherein the nanosheets are oriented obliquely to a proximate surface of the substrate.

18. The method of claim 1, further comprising changing the voltage, the metal material, the plurality of nanosheets, or a combination comprising at least one of the foregoing, to form a plurality of different coatings on the substrate.

19. The method of claim 1, wherein the nanosheets comprise graphene.

20. The method of claim 1, wherein the nanosheets comprise the cationic functional group which comprises the quaternary ammonium group, the quaternary phosphonium group, the tertiary sulfonium group, the alkyl pyridinium group, or a combination thereof.

21. The method of claim 1, wherein the basic functional group is covalently bonded to the nanosheets.

22. The method of claim 1, wherein the nano sheets comprise the basic functional group and the basic functional group is derived by nitration followed by reduction or by nucleophilic substitution by an amine, a substituted amine, or protected amine.

23. The method of claim 1, wherein the deposition composition further comprises a reducing agent that is effective to reduce the metal ions to the metal.

24. A method for coating a substrate, the method comprising:

disposing a deposition composition in a container, the deposition composition comprising:

a plurality of nanosheets; and a metal material to produce positively charged metal-containing ions in the deposition composition;

disposing a substrate in the container;

contacting the substrate with the deposition composition;

applying a DC voltage between the substrate and a counter electrode, the substrate being a cathode, and the counter electrode being an anode;

electrodepositing, on the substrate, a coating comprising:

a metal from the positively charged metal-containing ions; and the nanosheets, wherein the method further comprises disposing a reference electrode in the container;

the nanosheets comprise graphene, graphene oxide, or a combination comprising at least one of the foregoing and a basic or a cationic functional group, the basic functional group comprising a primary amino group, a secondary amino group, a tertiary amino group, or a combination thereof, and the cationic functional group comprising a quaternary ammonium group, a quaternary phosphonium group, a tertiary sulfonium group, an alkyl pyridinium group, or a combination thereof; and the substrate comprises aluminum, cobalt, copper, chromium, iron, lead, magnesium, manganese, molybdenum, nickel, niobium, tantalum, titanium, tungsten, vanadium, zirconium, silicon, zinc, a rare earth element, a metal alloy thereof, or a combination comprising at least one of the foregoing.

* * * * *